US011677189B2

(12) United States Patent
Blakborn

(10) Patent No.: US 11,677,189 B2
(45) Date of Patent: Jun. 13, 2023

(54) ELECTRICAL PLUG CONNECTOR AND METHOD FOR ASSEMBLING AN ELECTRICAL PLUG CONNECTOR

(71) Applicant: Rosenberger Hochfrequenztechnik GmbH & Co. KG, Fridolfing (DE)

(72) Inventor: Willem Blakborn, Inzell (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 58 days.

(21) Appl. No.: 17/353,215

(22) Filed: Jun. 21, 2021

(65) Prior Publication Data

US 2021/0408730 A1 Dec. 30, 2021

(30) Foreign Application Priority Data

Jun. 24, 2020 (EP) ..... 20181899

(51) Int. Cl.
*H01R 13/6581* (2011.01)
*H01R 13/50* (2006.01)
(Continued)

(52) U.S. Cl.
CPC ..... *H01R 13/6581* (2013.01); *H01R 13/50* (2013.01); *H01R 43/20* (2013.01); *H01R 13/6594* (2013.01)

(58) Field of Classification Search
CPC ..... H01R 13/6581; H01R 13/6594; H01R 13/502; H01R 13/50; H01R 43/20
(Continued)

(56) References Cited

U.S. PATENT DOCUMENTS 6,224,422 B1 * 5/2001 Zhu ..... H01R 23/6873 439/607.01
6,309,227 B1 * 10/2001 Chen ..... H01R 12/57 439/607.02

(Continued)

FOREIGN PATENT DOCUMENTS

CN 2491977 * 5/2002 ..... H01R 12/55
CN 108511936 A 9/2018

OTHER PUBLICATIONS

European Search Report dated Oct. 30, 2020.

*Primary Examiner* — Peter G Leigh
(74) *Attorney, Agent, or Firm* — Randall Danskin P.S.

(57) ABSTRACT

An electrical plug connector, having an electrically insulating housing assembly and an outer-conductor assembly connected in positively locking fashion to the housing assembly. The outer-conductor assembly has at least one fastening tab which can be bent from a basic state into a fastening state. The outer-conductor assembly is received in the housing assembly such that the housing assembly blocks relative movement between the outer-conductor assembly and the housing assembly in positively locking fashion along a first translational degree of freedom (x) and/or along a second translational degree of freedom (y). The fastening in the basic state, allows an assembling movement for assembling the housing assembly on the outer-conductor assembly along a third translational degree of freedom (z) and, in the bent fastening state, blocks the housing assembly on the outer-conductor assembly in positively locking fashion at least along the third translational degree of freedom (z).

22 Claims, 5 Drawing Sheets

(51) Int. Cl.
*H01R 43/20* (2006.01)
*H01R 13/6594* (2011.01)

(58) Field of Classification Search
USPC ..... 439/607.4
See application file for complete search history.

(56) References Cited

U.S. PATENT DOCUMENTS 6,386,918 B1 * 5/2002 Zheng ..... H01R 12/7023 439/607.53
6,419,529 B1 * 7/2002 Shi ..... H01R 25/006 439/607.02
7,052,322 B2 * 5/2006 Hu ..... H01R 13/6582 439/607.25
8,202,126 B2 * 6/2012 Lim ..... H01R 13/6581 439/607.31
8,251,747 B2 * 8/2012 He ..... H01R 13/6582 439/95
8,974,240 B2 * 3/2015 Yu ..... H01R 13/7032 439/188
9,093,784 B2 * 7/2015 Zhang ..... H01R 13/6582
9,893,473 B2 * 2/2018 Kong ..... H01R 13/658
10,236,638 B2 * 3/2019 Kong ..... H01R 13/6594
10,297,957 B2 * 5/2019 Zhao ..... H01R 12/724
10,355,421 B2 * 7/2019 Zhao ..... H01R 13/6594
10,367,309 B2 * 7/2019 Tsai ..... H01R 12/716
10,566,743 B2 * 2/2020 Zhao ..... H01R 13/6594
2007/0173119 A1 * 7/2007 Xiao ..... H01R 13/658 439/607.2
2010/0167584 A1 * 7/2010 He ..... H01R 12/707 439/607.01
2015/0333447 A1 * 11/2015 Bai ..... H01R 13/6456 439/607.54
2017/0271821 A1 * 9/2017 Xie ..... H01R 13/6585
2018/0191119 A1 * 7/2018 Zhao ..... H01R 43/24
2019/0229470 A1 * 7/2019 Cheng ..... H01R 13/405

* cited by examiner

ELECTRICAL PLUG CONNECTOR AND METHOD FOR ASSEMBLING AN ELECTRICAL PLUG CONNECTOR

CROSS REFERENCE TO RELATED APPLICATIONS

This Non-Provisional patent application is a United States National Stage Patent Application which claims the benefit of priority to earlier filed European Patent Application No. 20 181 899.4, which was filed on 24 Jun. 2020. The entire contents of the aforementioned earlier filed European Patent Application is expressly incorporated herein by this reference.

Pursuant to USPTO rules, this foreign priority claim to earlier filed European Patent Application No. 20 181 899.4 is also included in the Application Data Sheet (ADS) filed herewith.

TECHNICAL FIELD

The invention relates to an electrical plug connector, having an electrically insulating housing assembly, and an outer-conductor assembly connected in positively locking fashion to the electrically insulating housing assembly.

The invention furthermore relates to a method for assembling an electrical plug connector, in which method an electrically insulating housing assembly of the plug connector is connected in positively locking fashion to an outer-conductor assembly of the plug connector.

BACKGROUND

Various electrical plug connectors are known from the field of electrical engineering. Electrical plug connectors serve, as is known, for transmitting electrical supply signals and/or data signals to corresponding counterpart plug connectors. A plug connector or counterpart plug connector may be, in particular, a plug, a circuit board connector, a panel connector, a socket, a coupling or an adapter. The term "plug connector" and/or "counterpart connector" used in the context of the invention is representative of all variants.

High demands are placed, in particular, on the robustness and reliability of plug connectors for the automotive industry and/or for vehicles. Accordingly, a plug connection must withstand sometimes high loads, for example mechanical loads, and remain closed in defined fashion, such that the electrical connection is not inadvertently severed for example during the operation of the vehicle. Ensuring reliability is of primary concern in particular in the case of the autonomous operation of vehicles and for driver assistance systems.

In the case of the autonomous operation of a vehicle, or in the case of assistance systems being used, it is sometimes necessary for large amounts of data from several cameras, various sensors and navigation sources to be combined with one another and transported, normally in real time. The operation of numerous devices, screens and cameras accordingly requires a high-performance infrastructure in the vehicle electronics system. Accordingly, the demands on the plug connectors and the cable connections within a vehicle with regard to the required data rate have over time become very high. To save structural space and weight, it is furthermore important for the plug connectors to be designed to be as compact as possible.

A further demand on plug connectors for the automotive industry consists in that these should be producible economically, and in high unit quantities, and should be easy and reliable to assemble.

An electrical plug connector commonly has an electrically insulating housing assembly and an outer-conductor assembly which is mechanically connected to the housing assembly. The type of fastening between the housing assembly and the outer-conductor assembly plays a not insignificant role in defining the robustness, the size, the weight and the outlay for the production and assembly of the plug connector as a whole.

The fastening between the housing assembly and the outer-conductor assembly is often realized in practice by means of a so-called oversize fit or "interference fit". Alternatively, or in addition, assembly claws may be provided on the outer-conductor assembly, which assembly claws penetrate into a plastic housing assembly. In the case of both techniques, there is ultimately resulting damage to the housing assembly, which can in particular adversely affect the service life of the plug connector.

Also known from practice is a fixing between the housing assembly and the outer-conductor assembly by means of a combination of spring tabs and corresponding detent recesses. The outlay for the production of such a plug connector is however increased, and the plug connectors equipped with spring tabs and detent recesses generally take up a relatively large amount of structural space. Furthermore, the fastening can be released if subjected to relatively high pulling forces.

It is furthermore known to provide, on the outer-conductor assembly, at least one fastening tab which can be bent from a basic state into a fastening state. The fastening tab can then be folded around an edge of the housing assembly during the assembling of the plug connector. In this way, inexpensive and at the same time effective, positively locking fastening of an outer-conductor assembly on an insulating housing assembly is possible. Such a connecting technique is used for example in the generic EP 0 674 364 B1.

A plug connector equipped with such fastening tabs can generally tolerate higher pulling forces than a plug connector equipped with spring tabs and detent recesses. There is nevertheless a demand to further improve the fastening technique based on bendable fastening tabs, and in particular to make this available for use with an alternative plug connector construction.

In view of the known prior art, an object of the present invention therefore consists in providing an electrical plug connector which is in particular, of robust and durable design, and which can be produced economically, preferably in a mass production context.

The present invention is also based on an object of providing a method for assembling an electrical plug connector in order, in particular, to produce particularly robust and durable plug connectors economically, preferably in a mass production context.

The claims and the features disclosed herein are advantageous embodiments and variants of the invention.

An electrical plug connector is provided which has an electrically insulating housing assembly and an outer-conductor assembly which is connected in positively locking fashion to the housing assembly. The outer-conductor assembly has at least one fastening tab which can be bent from a basic state into a fastening state.

The electrically insulating housing assembly is preferably of single-part form, though may possibly also be of multi-part form. The housing assembly may for example optionally have seals and/or fastening elements.

The housing assembly is preferably formed exclusively from an electrically insulating material. The housing assembly may however basically also have electrically conductive components, for example connecting elements for connecting the plug connector to an electrical circuit board or to a corresponding counterpart plug connector, for example spring tabs, screw elements and/or detent elements.

The housing assembly may be formed partially, substantially or preferably entirely from a plastic.

The outer-conductor assembly is preferably of single-part form, though may possibly also be of multi-part form. The outer-conductor assembly may for example have a separate spring cage for connecting to the outer conductor of a corresponding counterpart plug connector, or separate connecting elements for connecting to an electrical assembly, for example a circuit board.

The outer-conductor assembly is preferably formed entirely from an electrically conductive material. The outer-conductor assembly may however basically also have electrically insulating components, for example seals and/or detent elements composed of plastic. The outer-conductor assembly is preferably designed to electromagnetically shield plug connector components of the electrical plug connector.

The outer-conductor assembly may be formed partially, substantially or preferably entirely from a metal, preferably a sheet metal.

The electrical plug connector may also have further plug connector components aside from the insulating housing assembly and the outer-conductor assembly. For example, it may be provided that the electrical plug connector has one or more inner-conductor contact elements which preferably extend through the outer-conductor assembly. It may also be provided that the electrical plug connector has one or more insulating parts composed of an electrically insulating material in order to electrically insulate the at least one inner-conductor contact element with respect to the outer-conductor assembly and mechanically fix said at least one inner-conductor contact element within the outer-conductor assembly. The electrical plug connector may basically also have any other desired components, such as seals or fastening, elements for fastening to an electrical assembly (for example to a cable or to a circuit board).

It is provided according to the invention that the outer-conductor assembly is received in the housing assembly. Here, the outer-conductor assembly is received in the housing assembly such that a relative movement between the outer-conductor assembly and the housing assembly is blocked in positively locking fashion along a first translational degree of freedom and/or along a second translational degree of freedom.

It may furthermore be provided that the outer-conductor assembly is received in the housing assembly such that an orientation between the outer-conductor assembly and the housing assembly is blocked in positively locking fashion along a first rotational degree of freedom and/or along a second rotational degree of freedom and/or along a third rotational degree of freedom.

The outer-conductor assembly is thus inserted at least in certain regions into the housing assembly, or is surrounded by the housing assembly at leash two mutually opposite sides, preferably along the full circumference. The outer-conductor assembly can thus be introduced into the housing assembly by means of an assembling movement that runs along a third translational degree of freedom. The inner wall of the housing assembly can then block a movement of the outer-conductor assembly relative to the housing assembly at least along a first translational degree of freedom and preferably furthermore along a second translational degree of freedom.

A fastening of an insulating housing assembly on an outer-conductor assembly is a usage situation that must not be neglected, in particular in the field of plug connectors for vehicles. A corresponding plug connector can be particularly robust and durable because, in the event of external damage, initially only the housing assembly sustains damage, and the function of the outer conductor or of the outer-conductor assembly, and thus the electrical usability of the plug connector, is maintained. Accordingly, in the event of damage to the plug connector, although it is possible, for example, for the interface for the connection to the counterpart plug connector to be damaged, the likelihood of a short circuit or of some other malfunction of the electrical connection can be reduced.

The plug connector is designed such that the at least one fastening tab, in the basic state, allows the assembling movement for assembling the housing assembly on the outer-conductor assembly along the third translational degree of freedom and, in the bent fastening state, blocks the housing assembly on the outer-conductor assembly in positively locking fashion at least along the third translational degree of freedom (and optionally additionally along the first translational degree of freedom and/or along the second translational degree of freedom).

By means of the proposed fastening, a solid undercut can be provided between the housing assembly and the outer-conductor assembly. In this way, the housing assembly can be significantly secured on the outer-conductor assembly, preferably such that pulling-off in a plugging-in direction of a corresponding counterpart plug connector or counter to the plugging-in direction of a corresponding counterpart plug connector is prevented. At the same time, a deformation of or other damage to the housing assembly, such as can be associated for example with an interference fit or with the use of claws, can be avoided.

A plug connector having an outer housing formed by an electrically insulating housing assembly, in which an outer-conductor assembly is in turn received, may advantageously be combined with a fastening technique based on bendable fastening tabs. A plug connector according to the invention can be of robust and nevertheless compact form and furthermore economically producible and assemblable.

In a preferred refinement of the invention, it may be provided that the bending axis along which the at least one fastening tab can be bent from the basic state, into the fastening state, runs parallel or at least substantially parallel, to the third translational degree of freedom.

By means of the stated orientation of the bending axis, a particularly stable and secure fastening can be provided by means of the at least one fastening tab.

The prior art has the disadvantage that, in the presence of unexpectedly high pulling forces, the fastening tab may be partially bent back again, and thus the connection between the housing assembly and the outer-conductor assembly may be loosened or even released entirely. This problem can be avoided if the bending direction does not run along the assembling movement or along the third translational degree of freedom but is oriented preferably orthogonally or at least approximately orthogonally with respect to the assembling movement.

Even if an orientation of the bending axis parallel to the third translational degree of freedom is preferred in order to achieve particularly high stability, it is however basically also possible for an angled orientation of the bending axis relative to the third translational degree of freedom to be provided, in particular an arbitrary angle between 0° and 90°, preferably an angle between 0° and 45°, particularly preferably an angle between 0° and 30°, very particularly preferably an angle between 0° and 20°, and even more preferably an angle between 0° and 10°, for example an angle of 0° to 5° or 0° to 2°.

Any desired number of fastening tabs may be provided in order to fasten the outer-conductor assembly to the housing assembly, for example also exactly one fastening tab. The use of at least two fastening tabs can however significantly increase the holding force between the housing assembly and the outer-conductor assembly, for which reason it is preferable for two fastening tabs or more fastening tabs to be provided. It is however also possible, for example, for three fastening tabs or more fastening tabs, four fastening tabs or more fastening tabs, five fastening tabs or more fastening tabs or six fastening tabs or even more fastening tabs to be provided.

If multiple fastening tabs are provided, the bending axes of all fastening tabs preferably run parallel to, or at least approximately parallel to, one another (wherein, in particular, tolerance-induced angle deviations, or angle deviations between 0° to 10°, may be provided). The bending axes of multiple fastening tabs may however also differ from one another, in particular may be oriented orthogonally with respect to one another.

In one refinement of the invention, it may be provided that the outer-conductor assembly has at least one fastening tab pair which is formed from two fastening tabs which are arranged on opposite sides of the outer-conductor assembly.

It has been found that in particular fastening tab pairs of two fastening tabs which are arranged on opposite sides of the outer-conductor assembly can lead to a particularly stable plug connector which can in particular also have high resistance to transverse forces.

It is possible for any number of fastening tab pairs to be provided. It has however been found that even a single fastening tab pair can suffice to provide a sufficiently robust fastening. It is however also possible, if appropriate, for two fastening tab pairs or more fastening tab pairs, three fastening tab pairs or more fastening tab pairs or four fastening tab pairs or even more fastening tab pairs to be provided.

In addition to the at least one fastening tab pair, it is for example also possible for a single further fastening tab to also be provided (or multiple further single fastening tabs).

The bending axes of the fastening tabs of a common fastening tab pair are particularly preferably oriented parallel to one another or at least substantially parallel to one another (wherein, in particular, tolerance-induced angle deviations, or angle deviations between 0° to 10°), may be provided).

In one refinement of the invention, it may be provided that the fastening tabs of a common fastening tab pair can be bent (with their free ends) toward one another proceeding from their respective basic state in order to attain their respective fastening state.

The fastening tabs of a common fastening tab pair may preferably be designed to engage in a "bracket-like" manner around a section of the housing assembly between the two fastening tabs. This can lead to a particularly stable and secure fastening.

It may however also be provided that the fastening tabs of a common fastening tab pair can be bent (with their free ends) away from one another, or along an arbitrary angle relative to one another, for example also orthogonally with respect to one another, proceeding from their respective basic state in order to attain their respective fastening state.

In one refinement of the invention, it may be provided that the fastening tabs of a common fastening tab pair are arranged at the same axial position along the longitudinal axis of the outer-conductor assembly.

Preferably, the fastening tabs of a common fastening tab pair may thus be arranged directly opposite one another. The fastening can be even more stable by way of this "symmetry" or the directly oppositely arranged fastening tabs.

It may however also be provided that the fastening tabs of a common fastening tab pair are arranged offset with respect to one another axially along the longitudinal axis of the outer-conductor assembly, for example such that the fastening tabs, if they are designed such that they can be bent toward one another, run adjacent to one another, preferably so as to directly adjoin one another, along the surface of the housing assembly in their bent fastening state.

The fastening tabs may then possibly be supported on one another in order to jointly dissipate the forces exerted on the plug connector, wherein, as before, simple bending of the individual fastening tabs can be performed during the assembly process without the technician having to exert an unduly high force.

It may be provided that the housing assembly has at least one fastening edge which, when the outer-conductor assembly has been received, preferably fully received, in the housing assembly, is positioned in the housing assembly such that at least one of the fastening tabs, in its fastening state, can engage in positively locking fashion behind the fastening edge in order to block the third translational degree of freedom.

In one refinement of the invention, it may be provided that the housing assembly has at least one first stop surface which, when the outer-conductor assembly is situated in the housing assembly and the at least one fastening tab is situated in its fastening state, blocks a displacement, directed counter to the assembling movement, of the outer-conductor assembly counter to the assembling movement in positively locking fashion along the third translational degree of freedom.

It is pointed out at this juncture that, in the context of the invention, instead of a (first or hereinafter further mentioned second) stop surface, some other (first and/or second) stop may also be provided. For example, the first stop may be formed by one or more pins each with a circular cross section, against which the at least one fastening tab abuts in positively locking fashion in its fastening state.

The housing assembly may basically have any desired number of first stop surfaces and/or fastening edges, in particular also only exactly one single first stop surface or fastening edge. It is however also possible, for example, for two first stop surfaces/fastening edges or more first stop surfaces/fastening edges, three first stop surfaces/fastening edges or more first stop surfaces/fastening edges, four first stop surfaces/fastening edges or more first stop surfaces/fastening edges, five first stop surfaces/fastening edges or more first stop surfaces/fastening edges or six first stop surfaces/fastening edges or even more first stop surfaces/fastening edges to be provided.

The number of first stop surfaces and/or fastening edges may correspond to the number of fastening tabs, wherein each first stop surface/fastening edge may be assigned to a corresponding fastening tab. The number of first stop surfaces/fastening edges is however preferably smaller than the number of fastening tabs, wherein at least two fastening tabs, preferably the two fastening tabs of a common fastening tab pair, are capable of engaging behind in each case one common first stop surface and/or fastening edge.

It may be provided that the fastening edge of the housing assembly is formed on a fastening groove and/or on a fastening web. It is also possible for a recess to be provided in the housing assembly to form a fastening edge.

In one advantageous refinement of the invention, it may be provided that the at least one first stop surface of the housing assembly is formed on a side wall of a fastening groove, on a side wall of a fastening web and/or by a step within a recess.

The fastening edge or the first stop surface, in particular a fastening edge or first stop surface formed by the fastening web, may preferably be arranged so as to adjoin one of the two ends of the housing assembly along the longitudinal axis. The fastening edge/first stop surface may however also be arranged in a central section of the housing assembly. A particularly stable fastening can be provided if the fastening is realized in the region of at least one of the two ends of the housing assembly.

In one refinement of the invention, it may be provided that the housing assembly has at least one second stop surface which forms an end stop for the insertion of the outer-conductor assembly into the housing assembly along the assembling movement. The second stop surface may for example block a further insertion of the outer-conductor assembly by blocking the displacement travel for the at least one fastening tab, or for some other component of the outer-conductor assembly or for some other section of the outer-conductor assembly, along the assembling movement.

The second stop surface may for example be formed directly by one of the side walls of the housing assembly, preferably by that side wall of the housing assembly in which the slot for the insertion of the outer-conductor assembly is formed.

In one refinement of the invention, it may be provided that the housing assembly has at least one bevel along which at least one of the fastening tabs can be bent from the basic state into the fastening state.

The bending of the fastening tabs can be performed in a particularly defined and gentle manner along the bevel.

In one advantageous refinement of the invention, it may be provided that an intended plugging-in direction along which the electrical plug connector can be connected to a corresponding counterpart plug connector is oriented parallel to the third translational degree of freedom.

Since a mechanical load on the plug connector is commonly introduced into the plug connector along or counter to the plugging-in direction proceeding from the corresponding counterpart plug connector, a particularly robust plug connector can be provided by way of the proposed fastening technique in particular if the fastening tabs are capable of accommodating predominantly forces along the assembling movement or along the third translational degree of freedom and simultaneously along the plugging-in direction.

Furthermore, the assembly of a plug connector along its later plugging-in direction is commonly particularly easily possible.

It may however also be provided that an intended plugging-in direction along which the electrical plug connector can be connected to a corresponding counterpart plug connector is oriented orthogonally or along some other angle with respect to the third translational degree of freedom. The assembling movement may thus possibly also deviate from the plugging-in direction.

In one advantageous refinement of the invention, it may be provided that the housing assembly has a mechanical interface for the connection of the electrical plug connector to a corresponding counterpart plug connector. The housing assembly preferably has the mechanical interface for the connection of the electrical plug connector to the corresponding counterpart plug connector at a first (front) end along its longitudinal axis.

The mechanical interface may have means for mechanical coding, in particular for ensuring a correct orientation of the plug connector and of the counterpart plug connector and/or for ensuring that only admissible counterpart plug connectors can be connected to the plug connector.

The mechanical interface may have detent means for detent engagement between the plug connector and the counterpart plug connector.

The mechanical interface may have one or more seals.

In one advantageous refinement of the invention, it may be provided that the outer-conductor assembly projects with an end section out of the housing assembly at a second (rear) end of the housing assembly which is situated opposite the mechanical interface.

By virtue of the fact that the outer-conductor assembly projects out of the housing assembly at the second end of the housing assembly, a mechanical and/or electrical connection to an electrical assembly (for example to a cable or to an electrical circuit board) can be made possible in a particularly simple manner.

Preferably, at least one of the fastening tabs (preferably all fastening tabs) is formed in the end section that projects out of the housing assembly.

An arrangement of the fastening tabs in the end section that projects out of the housing assembly can be advantageous in order to facilitate accessibility to the fastening tabs during the assembly process. Furthermore, the mechanical stability of the fastening can be further improved.

In one refinement of the invention, it may be provided that the outer-conductor assembly has connecting elements for the electrical contacting of at least one electrical conductor of an electrical assembly.

The outer-conductor assembly may preferably be formed as a single piece with the connecting elements. It may however also be provided that the outer-conductor assembly and the connecting elements are of multi-part form.

Any desired number of connecting elements may be provided for the electrical contacting with the electrical assembly, basically also only a single connecting element. It is however preferable for multiple connecting elements to be provided in order to ensure a particularly low-resistance electrical connection between the electrical assembly and the outer-conductor assembly.

In one refinement of the invention, it may be provided that the connecting elements are formed as contact pins, preferably press-in pins, for installation in a metal-plated hole defined in the electrical assembly (in particular in a so-called plated through-hole or a "via" of an electrical circuit board).

The connection by means of contact pins, in particular press-in pins, has proven to be particularly suitable for connecting the plug connector to the electrical assembly, in particular to a circuit board. It is however basically also possible for other connecting elements to be provided, in particular if the plug connector is to be connected to an electrical conductor of an electrical cable. In this case, it is for example possible for connecting elements to be provided which may be suitable for pressing together with or crimping with or cold welding to a conductor of an electrical cable.

In one advantageous refinement of the invention, it may be provided that the outer-conductor assembly is formed from a stamped and bent part.

Production of the outer-conductor assembly as a single piece from a metal sheet can be particularly suitable for mass production, in particular also for the formation of the fastening tabs.

The housing assembly may possibly be designed to receive more than one outer-conductor assembly, for example two outer-conductor assemblies or more outer-conductor assemblies, three outer-conductor assemblies or more outer-conductor assemblies, four outer-conductor assemblies or even more outer-conductor assemblies. Alternatively, or in addition, it may be provided that the at least one outer-conductor assembly is designed to shield multiple inner-conductor contact elements separately from one another.

The electrical plug connector may preferably be in the form of an angled plug connector. The electrical plug connector may however also be of non-angled form.

The electrical plug connector is preferably in the form of a circuit board plug connector (plug or socket) or in the form of a cable plug connector (plug or coupling).

The electrical plug connector may in particular be designed to provide a modular plug connector system, for example an H-MTD plug connector. The electrical plug connector is however not limited to a specific plug connector type, wherein the invention is particularly suitable for plug connectors for high-frequency technology. It may in particular also be, but is not limited to, a plug connector of type PL, BNC, TNC, SMBA (FAKRA), SMA, SMB, SMS, SMC, SMP, BMS, HEM (FAKRA-Mini), BMK, Mini-Coax or MATE-AX.

The plug connector may particularly advantageously be used within a vehicle, in particular a motor vehicle. Here, the expression "vehicle" describes any means of transport, in particular vehicles for use on and, on water or in the air, and also includes spacecraft. Possible fields of use are autonomous driving, driver assistance systems, navigation systems, "infotainment" systems, rear-seat entertainment systems, Internet connections and Wireless Gigabit (IEEE 802.11ad standard). Possible applications relate to high-resolution cameras, for example 4K and 8K cameras, sensor arrangements, on-board computers, high-resolution screens, high-resolution dashboards, 3D navigation units and mobile radio units.

The plug connector is suitable for any applications within the entire field of electrical engineering, and is not to be understood as being limited to use in automotive engineering.

The invention also relates to a method for assembling an electrical plug connector, in which method an electrically insulating housing assembly of the plug connector is connected in positively locking fashion to an outer-conductor assembly of the plug connector. It is provided that, for the positively locking connection, at least one fastening tab is bent from a basic state into a fastening state.

It is provided that the outer-conductor assembly is received by the housing assembly such that the housing assembly blocks a relative movement between the outer-conductor assembly and the housing assembly in positively locking fashion along a first translational degree of freedom and/or along a second translational degree of freedom. The housing assembly can be inserted into the housing assembly by means of an assembling movement running along a third translational degree of freedom whilst the at least one fastening tab is situated in its basic state. After the outer-conductor assembly has reached the end state in the housing assembly, the at least one fastening tab is bent into its fastening state in order to block the housing assembly on the outer-conductor assembly in positively locking fashion at least along the third translational degree of freedom.

It is advantageously thus possible to provide that an insulating housing assembly is held fixedly on an outer-conductor assembly. For this purpose, it is preferably possible firstly for the housing assembly to be pushed axially over the outer-conductor assembly (or vice versa) along the plugging-in direction of a corresponding counterpart plug connector. An assembling, movement orthogonal with respect to the plugging-in direction may also be provided. Subsequently, at least one strip-like section or at least one bendable fastening tab, which is arranged, at one axial end of the outer-conductor assembly, so as to run orthogonally with respect to the longitudinal axis of the outer-conductor assembly, can preferably be bent. Here, the at least one fastening tab, in the bent fastening state, may engage in positively locking fashion into a preferably hook-shaped, for example L-shaped elongation at the same axial end of the housing assembly, and form a positively locking connection.

The positive locking between the housing assembly and the outer-conductor assembly by means of the at least one bendable fastening tab results in particularly secure fixing between the housing assembly and the outer-conductor assembly if the outer-conductor assembly is furthermore received by the housing assembly.

Features that have been described in conjunction with the electrical plug connector can of course also be advantageously applied to the method—and vice versa. Advantages that have been mentioned in relation to the plug connector can furthermore also be understood in terms of the method—and vice versa.

In addition, it should be noted that expressions such as "comprising", "having" or "with" do not exclude any other features or steps. Furthermore, expressions such as "a" or "the" that refer in the singular to steps or features do not exclude a plurality of features or steps—and vice versa.

Note that terms such as "first" or "second" etc, are used predominantly for the sake of distinguishability between respective device or method features, and are not imperatively intended to indicate that features are mutually dependent or relate to one another.

It is furthermore emphasized that the values and parameters described in the present case also encompass deviations and fluctuations of ±10% or less, preferably ±5% or less, more preferably ±1% or less, and very particularly preferably ±0.1% or less, of the respectively stated value or parameter, if such deviations are not ruled out in practice in the implementation of the invention. The specification of ranges by way of start and end values also encompasses all values and fractions encompassed by the respectively stated range, in particular the start and end values and a respective mean value.

An electrical plug connector, having an electrically insulating housing assembly and an outer-conductor assembly connected in positively locking fashion to the housing assembly, wherein the outer-conductor assembly has at least one fastening tab which can be bent from a basic state into a fastening state, wherein the bending axis along which the fastening tab can be bent from the basic state into the fastening state runs parallel or at least substantially parallel to an assembling movement for the assembling-together of the housing assembly and the outer-conductor assembly. The further features disclosed herein, including those disclosed in the claims relate to advantageous embodiments and variants of this plug connector.

Exemplary embodiments will be described in more detail below with reference to the Figures.

SUMMARY

A principal aspect of the present invention is an electrical plug connector (1), having an electrically insulating housing assembly (2) and an outer-conductor assembly (3) connected in positively locking fashion to the housing assembly (2), wherein the outer-conductor assembly (3) has at least one fastening tab (8) which can be bent from a basic state into a fastening state, characterized in that the outer-conductor assembly (3) is received in the housing assembly (2) such that the housing assembly (2) blocks a relative movement between the outer-conductor assembly (3) and the housing assembly (2) in positively locking fashion along a first translational degree of freedom (x) and/or along a second translational degree of freedom (y), wherein the fastening tab (8), in the basic state, allows an assembling movement for assembling the housing assembly (2) on the outer-conductor assembly (3) along a third translational degree of freedom (z) and, in the bent fastening state, blocks the housing assembly (2) on the outer-conductor assembly (3) in positively locking fashion at least along the third translational degree of freedom (z).

A further aspect of the present invention is an electrical plug connector (1), characterized in that the bending axis (B) along which the fastening tab (8) can be bent from the basic state into the fastening state runs parallel or at least substantially parallel to the third translational degree of freedom (z).

A further aspect of the present invention is an electrical plug connector (1), characterized in that the outer-conductor assembly (3) has at least one fastening tab pair (9) which is formed from two fastening tabs (8) which are arranged on opposite sides of the outer-conductor assembly (3).

A further aspect of the present invention is an electrical plug connector (1), characterized in that the fastening tabs (8) of a common fastening tab pair (9) can be bent toward one another proceeding from their respective basic state in order to attain their respective fastening state.

A further aspect of the present invention is an electrical plug connector (1), characterized in that the fastening tabs (8) of a common fastening tab pair (9) are arranged at the same axial position along the longitudinal axis (L) of the outer-conductor assembly (3).

A further aspect of the present invention is an electrical plug connector (1), characterized in that the housing assembly (2) has at least one first stop surface (10) which, when the outer-conductor assembly (3) is situated in the housing assembly (2) and the at least one fastening tab (8) is situated in its fastening state, blocks a displacement, directed counter to the assembling movement, of the outer-conductor assembly (3) counter to the assembling movement in positively locking fashion along the third translational degree of freedom (z).

A further aspect of the present invention is an electrical plug connector (1), characterized in that the at least one first stop surface (10) of the housing assembly (2) is formed on a side wall of a fastening groove, on a side wall of a fastening web (11) and/or by a step within a recess.

A further aspect of the present invention is an electrical plug connector (1) 7, characterized in that the housing assembly (2) has at least one second stop surface (10') for the at least one fastening tab (8), which at least one second stop surface forms an end stop for the insertion of the outer-conductor assembly (3) into the housing assembly (2) along the assembling movement.

A further aspect of the present invention is an electrical plug connector (1), characterized in that the housing assembly (2) has at least one bevel (12) along which at least one of the fastening tabs (8) can be bent from the basic state into the fastening state.

A further aspect of the present invention is an electrical plug connector (1), characterized in that an intended plugging-in direction (S) along which the electrical plug connector (1) can be connected to a corresponding counterpart plug connector is oriented parallel to the third translational degree of freedom (z).

A further aspect of the present invention is an electrical plug connector (1), characterized in that the housing assembly (2) has a mechanical interface for the connection of the electrical plug connector (1) to a corresponding counterpart plug connector.

A further aspect of the present invention is an electrical plug connector (1), characterized in that the outer-conductor assembly (3) projects with an end section (6) out of the housing assembly (2) at an end (5) of the housing assembly (2) which is situated opposite the mechanical interface, wherein at least one of the fastening tabs (8), preferably all fastening tabs (8), are formed in the end section (6) that projects out of the housing assembly (2).

A further aspect of the present invention is an electrical plug connector (1), characterized in that the outer-conductor assembly (3) has contact pins, preferably press-in pins (7), for installation in a metal-plated hole of an electrical assembly.

A still further aspect of the present invention is an electrical plug connector (1), characterized in that the outer-conductor assembly (3) is formed from a stamped and bent part.

An even still further aspect of the present invention is a method for assembling an electrical plug connector (1), in which method an electrically insulating housing assembly (2) of the plug connector (1) is connected in positively locking fashion to an outer-conductor assembly (3) of the plug connector (1), wherein, for the positively locking connection, at least one fastening tab (8) is bent from a basic state into a fastening state, characterized in that the outer-conductor assembly (3) is received by the housing assembly (2) such that the housing assembly (2) blocks a relative movement between the outer-conductor assembly (3) and the housing assembly (2) in positively locking fashion along a first translational degree of freedom (x) and/or along a second translational degree of freedom (y), wherein the housing assembly (2) is inserted into the housing assembly (2) by means of an assembling movement (M) running along a third translational degree of freedom (z) whilst the at least one fastening tab (8) is situated in its basic state, and wherein, after the outer-conductor assembly (3) has reached the end state in the housing assembly (2), the at least one fastening tab (8) is bent into its fastening state in order to block the housing assembly (2) on the outer-conductor assembly (3) in positively locking fashion at least along the third translational degree of freedom (z).

BRIEF DESCRIPTIONS OF THE FIGURES

The Figures each show preferred exemplary embodiments in which individual features of the present invention are illustrated in combination with one another. Features of one exemplary embodiment may also be implemented separately from the other features of the same exemplary embodiment, and may accordingly be readily combined by an expert to form further useful combinations and sub-combinations with features of other exemplary embodiments.

Elements of identical function are denoted by the same reference designations in the Figures.

In the Figures, in each case schematically:

DETAILED WRITTEN DESCRIPTION OF THE PREFERRED EMBODIMENTS

This disclosure of the invention is submitted in furtherance of the Constitutional purposes of the US Patent Laws "to promote the progress of science and useful arts" (Article 1, Section 8).

Figure 1:
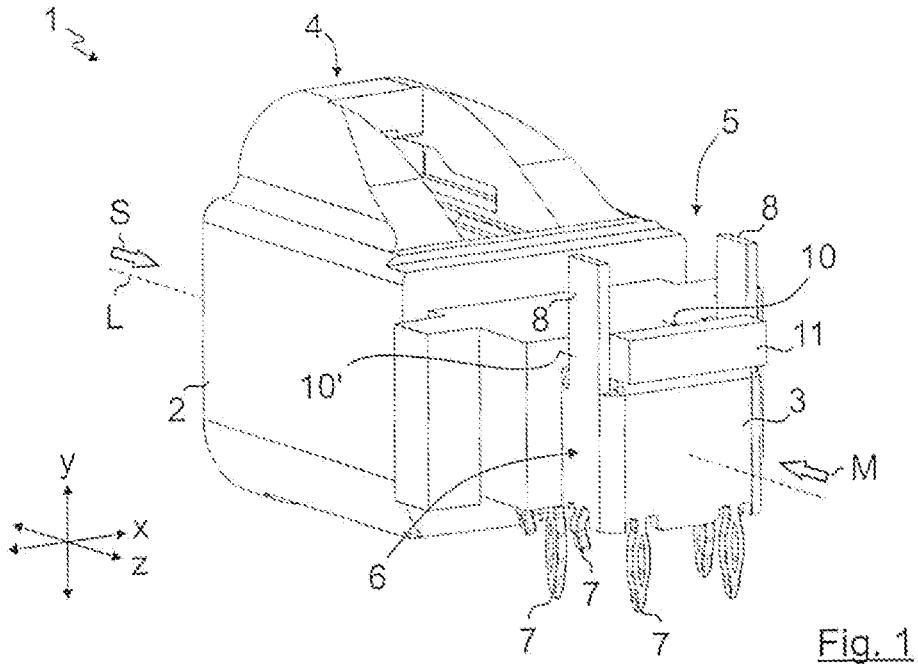
FIG. 1 shows an electrical plug connector having an electrically insulating housing assembly, and having an outer-conductor assembly, in a perspective illustration in a partially assembled state with two fastening tabs in a respective basic state.
Figure 2:
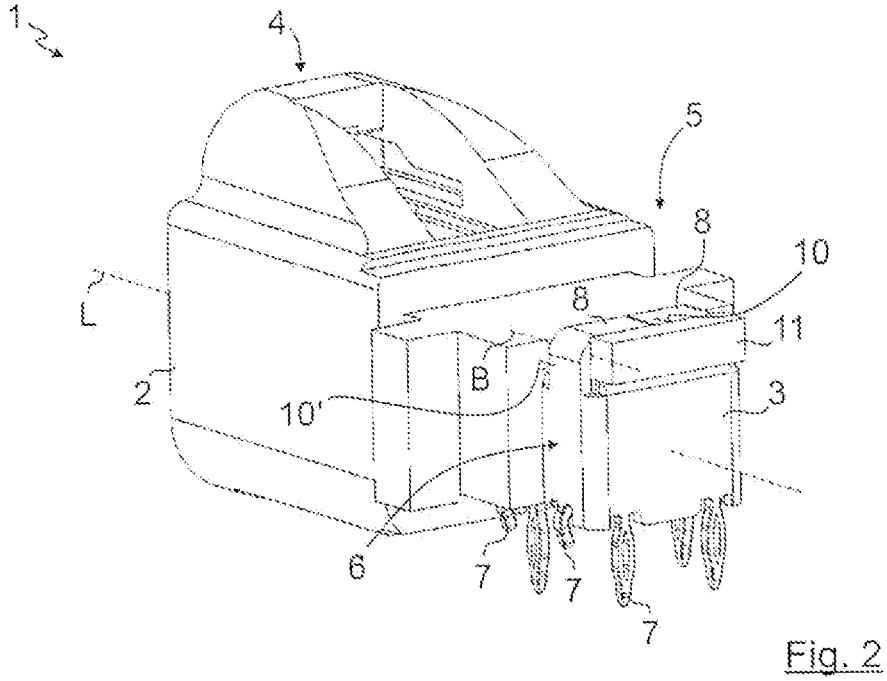
FIG. 2 shows the electrical plug connector of FIG. 1 in the fully assembled state with the fastening tabs in a respective bent fastening state.

FIGS. 1 and 2 show an electrical plug connector 1 according to the invention according to a first exemplary embodiment of the invention in a perspective illustration. FIG. 1 shows the electrical plug connector 1 in a partially assembled state, and FIG. 2 shows said electrical plug connector in a fully assembled state, in each case in a view of a rear end of the plug connector 1, which rear end is averted from a corresponding counterpart plug connector (not illustrated).

Figure 3:
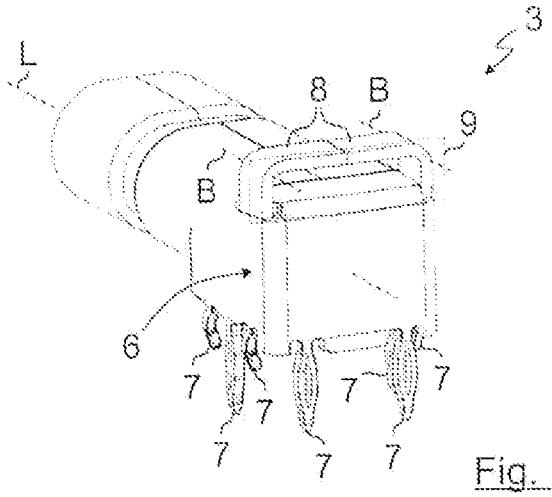
FIG. 3 shows the otter-conductor assembly of FIG. 2 in a perspective illustration on its own.
Figure 4:
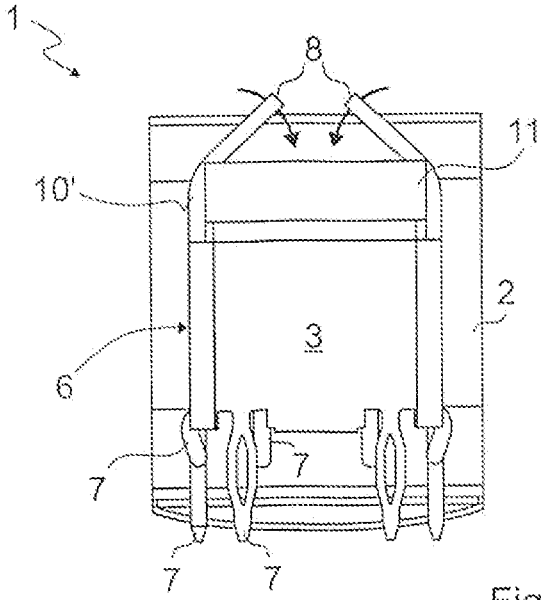
FIG. 4 shows the electrical plug connector of FIG. 1 in a rear view with partially bent fastening tabs.

The electrical plug connector 1 has an electrically insulating housing assembly 2, preferably a single-piece housing assembly 2 composed of a plastic, and an outer-conductor assembly 3 which is connected in positively locking fashion to the insulating housing assembly 2. The outer-conductor assembly 3 is illustrated separately in FIG. 3.

The outer-conductor assembly 3 is received in the insulating housing assembly 2. The insulating housing assembly 2 thus blocks a relative movement between the outer-conductor assembly 3 and the insulating housing assembly 2 in positively locking fashion along a first translational degree of freedom x and along a second translational degree of freedom y (cf. FIG. 1).

In the exemplary embodiments, the electrical plug connector 1 is designed by way of example as an angled circuit board plug connector of type H-MTD, though the electrical plug connector 1 may basically be of any other design.

Aside from the housing assembly 2, and the outer-conductor assembly 3, the electrical plug connector 1 may also have further plug connector components, in particular one or more inner-conductor contact elements (not illustrated in the Figures) and possibly an insulating part (likewise not illustrated) which insulates the inner-conductor contact elements from one another, and from the outer-conductor assembly 3.

The housing assembly 2 may, at a front, first end 4 along a longitudinal axis L, have a mechanical interface for the connection of the electrical plug connector 1 to the corresponding counterpart plug connector. The mechanical interface may in particular have means for mechanical coding and/or for detent engagement with the counterpart plug connector.

The outer-conductor assembly 3, in the state in which it is received in the housing assembly 2, may project, with an end section 6, out of the housing assembly 2 at a rear, second end 5 of the housing assembly 2, which is situated opposite the mechanical interface or the first end 4 of the insulating housing assembly 2. At said end section 6, there may preferably be provided connecting elements 7 for electrical contacting of at least one electrical conductor of an electrical assembly or circuit board (not illustrated). In the exemplary embodiments, the connecting elements 7 are designed as contact pins, in particular as press-in pins 7, in different configurations and can, for the assembly process, be received in a metal-plated hole of the electrical assembly, in particular in a plated through-hole defined in a circuit board.

The outer-conductor assembly 3 may preferably be formed from a stamped and bent part.

In the exemplary embodiments of FIGS. 1 to 7 and 9, the outer-conductor assembly 3 has two bendable fastening tabs 8. It is basically possible for any number of fastening tabs 8 to be provided, for example also only a single fastening tab 8 (cf. the exemplary embodiments of FIGS. 8 and 10). The use of at least two fastening tabs 8 has however proven to be particularly advantageous for the purposes of providing a robust fastening.

In a basic state, the fastening tab 8 initially allows an assembling movement M for the assembling of the insulating housing assembly 2 on the outer-conductor assembly 3 along a third translational degree of freedom z (cf. in particular FIG. 1). The outer-conductor assembly 3 can thus be inserted into the insulating housing assembly 2 along the third translational degree of freedom z for as long as the at least one fastening tab 8 is still situated in its basic state. By contrast, in a bent fastening state, the at least one fastening tab 8 blocks the insulating housing assembly 2 on the outer-conductor assembly 3 in positively locking fashion at least along the third translational degree of freedom z, as illustrated by way of example in FIGS. 2 and 7. Preferably, in its bent fastening state, the at least one fastening tab 8 blocks a relative movement between the outer-conductor assembly 3 and the insulating housing assembly 2 along all three translational degrees of freedom x, y, z.

A very particularly stable or robust fastening capability can be provided if the respective bending axis B along which the fastening tab 8 can be bent from the basic state into the fastening state runs parallel to, or at least substantially parallel to, the third translational degree of freedom z, as illustrated in all of the exemplary embodiments of FIGS. 1 to 9. Alternatively, it may however also be provided that the bending axis B runs along an angle, in particular orthogonally, with respect to the third translational degree of freedom z, as will be described in more detail herein on the basis of the exemplary embodiment shown in FIG. 10.

In the exemplary embodiments of FIGS. 1 to 7 and 9, the outer-conductor assembly 3 has at least one fastening tab pair 9 (cf. FIG. 3) which is formed from two fastening tabs 8 which are arranged on mutually opposite sides of the outer-conductor assembly 3. The fastening tabs 8 of the common fastening tab pair 9 can be bent with their free ends toward one another proceeding from their respective basic state in order to attain their respective fastening state (cf. for example the intermediate state shown in FIG. 4).

Figure 9:
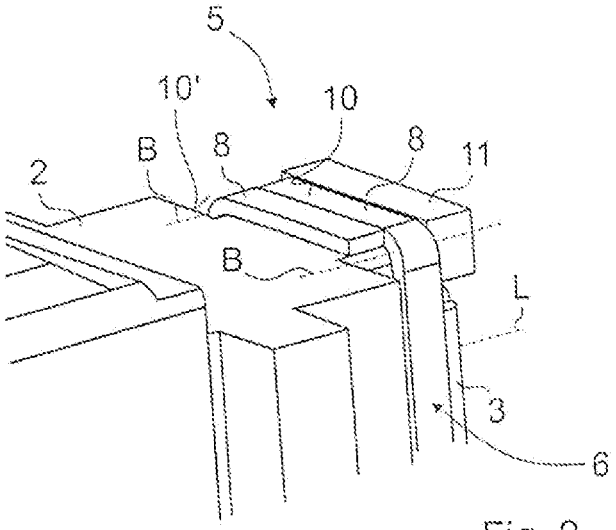
FIG. 9 shows a perspective enlarged detail view of the first stop surface of an electrical plug connector according to a third exemplary embodiment, with two fastening tabs offset along the longitudinal axis of the outer-conductor assembly, after the bending of the fastening tabs.
Figure 10:
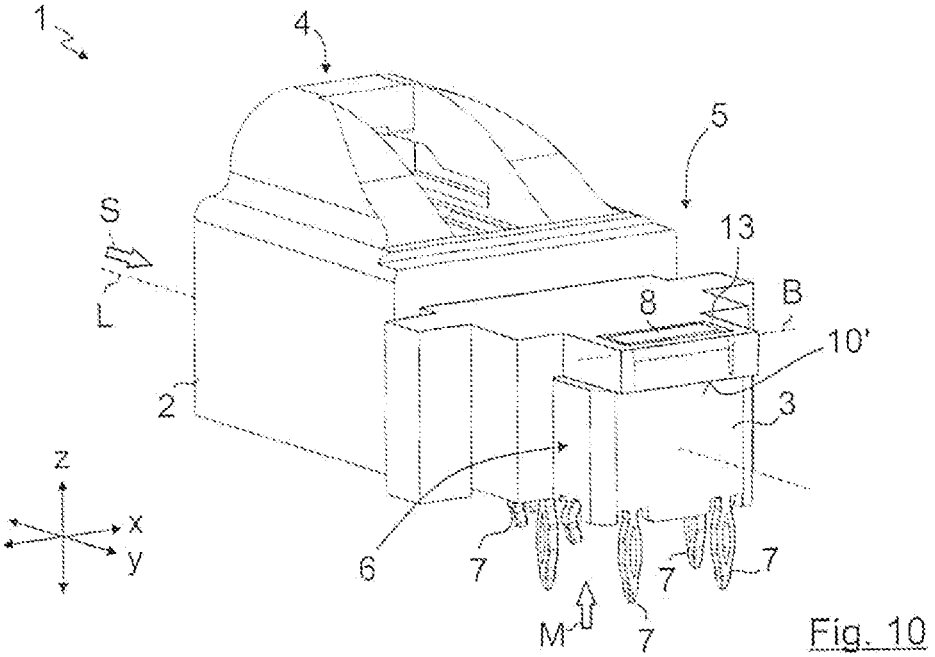
FIG. 10 shows an electrical plug connector according to a fourth exemplary embodiment, in a fully assembled state, with a fastening tab, the bending axis of which is oriented orthogonally with respect to the assembling movement.

The insulating housing assembly 2 has at least one first stop surface 10 (exactly one first stop surface 10 in the exemplary embodiments). When the outer-conductor assembly 3 is situated in the insulating housing assembly 2 and the fastening tabs 8 are situated in their fastening state, the first stop surface 10 blocks a displacement of the outer-conductor assembly 3 counter to the assembling direction. Such a connection is also known under the expressions "undercut" or "interlocking". In the exemplary embodiments of FIGS. 1 to 9, the first stop surface 10 of the insulating housing assembly 2 is formed on a side wall, facing toward the counterpart plug connector, of a fastening web 11 (of, in particular FIG. 5). The first stop surface 10 may however also be formed on a side wall of a fastening groove, in or behind a recess, or as some other surface. In FIG. 10, the first stop surface 10 is formed for example by a step within a recess 13.

To simplify the assembly process and to provide a particularly stable fastening, the fastening tabs 8 are, in the exemplary embodiments, arranged in that end section 6 of the outer-conductor assembly 3 which projects out of the insulating housing assembly 2.

Figure 5:
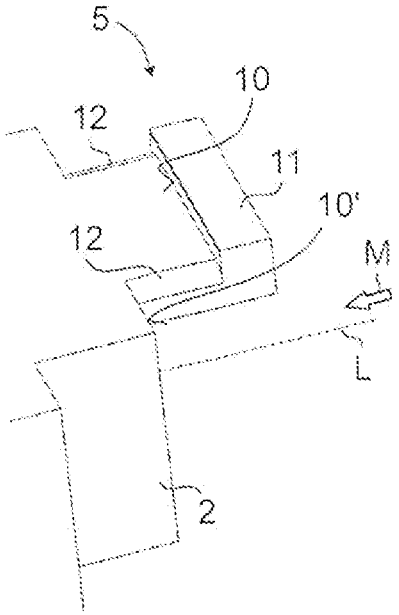
FIG. 5 shows a perspective enlarged detail view of the electrical plug connector of FIG. 1 for the purposes of illustrating a first stop surface of the housing assembly before the insertion of the outer-conductor assembly, into the housing assembly.
Figure 6:
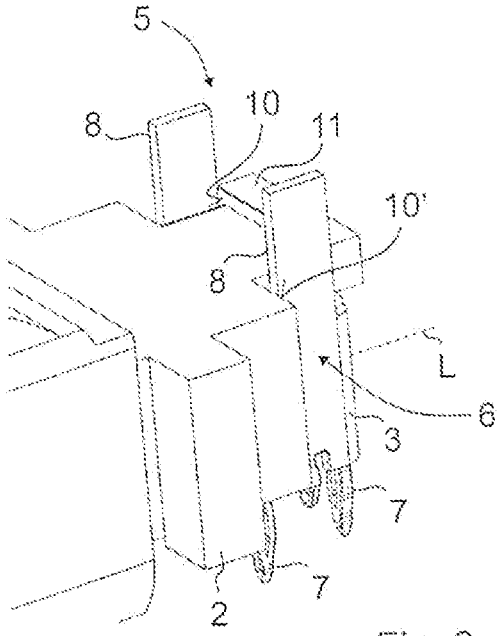
FIG. 6 shows the detail illustrated in FIG. 5, after the insertion of the outer-conductor assembly into the housing assembly and before the bending of the fastening tabs.
Figure 7:
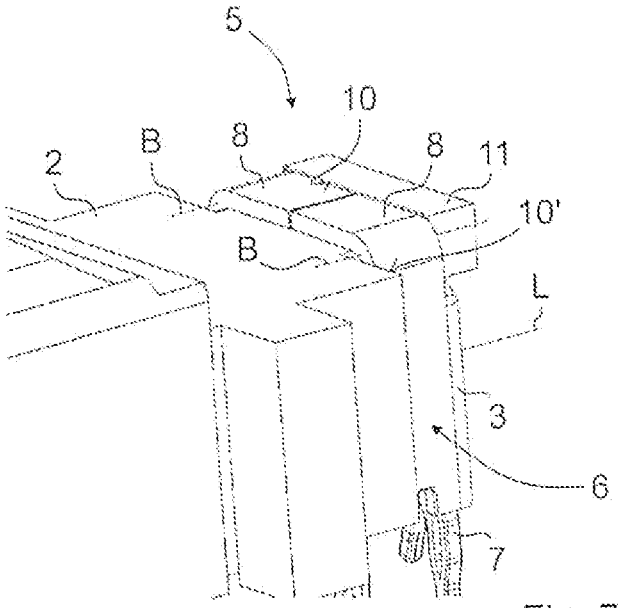
FIG. 7 shows the detail illustrated in FIG. 6, after the bending of the fastening tabs.

FIGS. 5 to 7 show a method for assembling the electrical plug connector 1 in multiple assembling steps. During the course of the assembling, the insulating housing assembly 2 of the plug connector 1 can be connected in positively locking fashion to the outer-conductor assembly 3 of the plug connector 1. For this purpose, the outer-conductor assembly 3 can be inserted into the insulating housing assembly 2 by means of an assembling movement M running along a third translational degree of freedom z, as can be seen from a comparison of FIGS. 5 and 6. Subsequently, the at least one fastening tab 8 can be bent from its basic state into its fastening state, as can be seen in particular from a comparison of FIGS. 6 and 7.

For an end stop of the assembling movement, it may be provided that the housing assembly 2 has at least one second stop surface 10'. In the exemplary embodiments, the second stop surface 10' is provided in that side wall of the insulating housing assembly 2 in which the slot for the outer-conductor assembly 2 is formed. In the exemplary embodiments of FIGS. 1 to 9, the second stop surface 10' in this case blocks the outer-conductor assembly 3 by way of the fastening tabs 8 thereof. By contrast, in the exemplary embodiment illustrated in FIG. 10, the second stop surface 10' blocks the outer-conductor assembly 3 directly by way of the outer surface, facing toward the second stop surface 10', of the outer-conductor assembly 3.

In order to facilitate the bending, the insulating housing assembly 2 may have at least one bevel 12 along which at least one of the fastening tabs 8 is bent from the basic state into the fastening state (cf. in particular FIG. 5).

Figure 8:
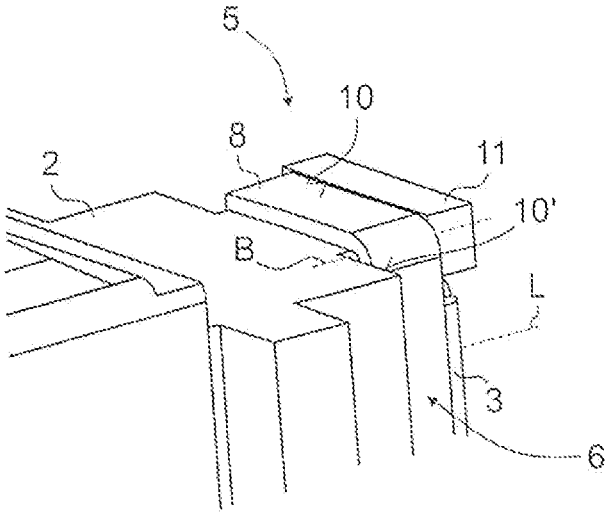
FIG. 8 shows a perspective enlarged detail view of the first stop surface of an electrical plug connector, according to a second exemplary embodiment, with exactly one fastening tab, after the bending of the fastening tab.

As already disclosed, it is possible for any number of fastening tabs 8 to be provided, for example also only a single fastening tab 8, as indicated by way of example in FIG. 8. In particular, fastening tabs 8 for the fastening of the housing assembly 2 and of the outer-conductor assembly 3 may also be provided in the region of the front, first end 4 of the housing assembly 2 and/or in a central section of the housing assembly 2.

Preferably, the fastening tabs 8 of a common fastening tab pair 9 are arranged at the same axial position along the longitudinal axis L of the outer-conductor assembly 3 as illustrated in the exemplary embodiment of FIGS. 1 to 7. It is however also possible for an axial offset to be provided between the fastening tabs 8, for example an offset as indicated in FIG. 9. It may thus be provided that the fastening tabs 8 of a common fastening tab pair 9 are supported axially against one another, which can strengthen the fastening without significantly increasing the force that has to be expended by a technician for the bending of the fastening tabs 8.

In the exemplary embodiments of FIGS. 1 to 9, the electrical plug connector 1 is designed such that the intended plugging-in direction S (cf. FIG. 1) along which the electrical plug connector 1 is connectable to the corresponding counterpart plug connector is oriented parallel to the third translational degree of freedom z. In this way, a particularly robust electrical plug connector 1 can be provided.

It may however also be provided that the assembling movement M deviates from the plugging-in direction S, as illustrated in FIG. 10. The outer-conductor assembly 3 can then be inserted into the housing assembly 2 for example orthogonally with respect to the plugging-in direction S. At least one fastening tab 8 (only a single fastening tab 8 is illustrated by way of example in FIG. 10) can subsequently be bent into its fastening state. For this purpose, the fastening tab 8 may for example be led through a recess 13 in the housing assembly 2 and subsequently bent over a fastening edge of a step formed in the recess 13, in order to form the above-described positive locking with the stop surface 10 formed by the step.

Also shown by way of example in FIG. 10 is a fastening tab 8 with a bending axis B which is oriented orthogonally with respect to the assembling movement M.

The electrical plug connector 1 illustrated in FIG. 10 may preferably also have further fastening means, in particular fastening tabs 8, in the region of the front, first end 4 and/or of the central section of the housing assembly 2.

OPERATION

A principal object of the present invention is an electrical plug connector (1), comprising: an electrically insulating housing assembly (2); and an outer-conductor assembly (3) that is connected in a positively locking fashion to the electrically insulating housing assembly (2); and wherein the outer-conductor assembly (3) has at least one fastening tab (8), and the at least one fastening tab can be bent from a basic state into a fastening state; and the outer-conductor assembly (3) is received in the electrically insulating housing assembly (2) such that the electrically insulating housing assembly (2) blocks a relative movement between the outer-conductor assembly (3) and the electrically insulating housing assembly (2) in positively locking fashion along at least one of a first translational degree of freedom (x) and/or along a second translational degree of freedom (y), and wherein the at least one fastening tab (8), in the basic state, allows an assembling movement for assembling the electrically insulating housing assembly (2) on the outer-conductor assembly (3) along a third translational degree of freedom (z) and, the at least one fastening tab (8) in the bent fastening state, blocks the electrically insulating housing assembly (2) on the outer-conductor assembly (3) in positively locking fashion at least along the third translational degree of freedom (z).

A further object of the present invention is an electrical plug connector (1) wherein a bending axis (B) along which the at least one fastening tab (8) can be bent from the basic state into the fastening state is parallel to, or at least substantially parallel to, the third translational degree of freedom (z).

A further object of the present invention is an electrical plug connector (I) and further comprising: at least one fastening tab pair (9) which is formed from two fastening tabs (8) which are arranged on opposite sides of the outer-conductor assembly (3).

A further object of the present invention is an electrical plug connector (1) wherein the fastening tabs (8) of the at least one fastening tab pair (9) can be bent toward one another from the basic state to the fastening state.

A further object of the present invention is an electrical plug connector (1) wherein the fastening tabs (8) of the at least one fastening tab pair (9) are arranged at a same axial position along a longitudinal axis (L) of the outer-conductor assembly (3).

A further object of the present invention is an electrical plug connector (1) wherein the electrically insulating housing assembly (2) has at least one first stop surface (10) which, when the outer-conductor assembly (3) is in the electrically insulating housing assembly (2), and the at least one fastening tab (8) is in the fastening state, blocks displacement, counter to the assembling movement, of the outer-conductor assembly (3), and counter to the assembling movement in positively locking fashion along the third translational degree of freedom (z).

A further object of the present invention is an electrical plug connector (1) wherein the at least one first stop surface (10) of the electrically insulating housing assembly (2) is formed on a side wall of a fastening groove.

A further object of the present invention is an electrical plug connector (1) and further comprising at least one second stop surface (10) carried by the electrically insulating housing for the at least one fastening tab (8); and the at least one second stop surface forms an end stop for the insertion of the outer-conductor assembly (3) into the electrically insulating housing assembly (2) along the assembling movement.

A further object of the present invention is an electrical plug connector (1) wherein the electrically insulating housing assembly (2) has at least one bevel (12) along which at least one of the at least one fastening tabs (8) can be bent from the basic state into the fastening state.

A further object of the present invention is an electrical plug connector (1) wherein an intended plugging-in direction (S) along which the electrical plug connector (1) can be connected to a corresponding counterpart plug connector is parallel to the third translational degree of freedom (z).

A further object of the present invention is an electrical plug connector (1) and further comprising a mechanical interface carried by the electrically insulating housing (2) for connection of the electrical plug connector (1) to a corresponding counterpart plug connector.

A further object of the present invention is an electrical plug connector (1) wherein the outer-conductor assembly (3) has an end section (6) that projects out of the electrically insulating housing assembly (2) at an end (5) of the electrically insulating housing assembly (2) which is opposite the mechanical interface, and wherein at least one of the at least one fastening tabs (8), are formed in the end section (6) that projects out of the electrically insulating housing assembly (2).

A further object of the present invention is an electrical plug connector (1) and further comprising contact pins, preferably press-in pins (7), carried by the outer-conductor assembly (3) for installation in a metal-plated hole defined in an electrical assembly.

A further object of the present invention is an electrical plug connector (1) wherein the outer-conductor assembly (3) is formed from a stamped and bent part.

A further object of the present invention is a method for assembling an electrical plug, connector (1), the method comprising the steps: providing an electrically insulating housing assembly (2); and providing an outer-conductor assembly (3); and connecting the electrically insulating housing assembly to the outer-conductor assembly (3) by inserting the outer conductor assembly (3) into the electrically insulating housing assembly (2) in an assembling movement (M) that extends along a third translational degree of freedom (z) whilst at least one fastening tab (8) carried by the outer-conductor assembly (3) is in a basic state, and wherein, after the outer-conductor assembly (3) has reached an end state in the electrically insulating housing assembly (2), the at least one fastening tab (8) is bent into a fastening state to block the electrically insulating housing assembly (2) on the outer-conductor assembly (3) in positively locking fashion at least along the third translational degree of freedom (z); and-the outer-conductor assembly (3) is received by the electrically insulating housing assembly (2) so that the electrically insulating housing assembly (2) blocks a relative movement between the outer-conductor assembly (3) and the electrically insulating housing assembly (2) in positively locking fashion along at least one of a first translational degree of freedom (x) or along a second translational degree of freedom (y); and bending at least one fastening tab (8) from the basic state into the fastening state to create the positively locking connection at least along the third translational degree of freedom (z).

A further object of the present invention is an electrical plug connector (1), wherein the outer-conductor assembly (3) is received in the electrically insulating housing assembly (2) such that the electrically insulating housing assembly (2) blocks the relative movement between the outer-conductor assembly (3) and the electrically insulating housing assembly (2) in positively locking fashion along the first translational degree of freedom (x) and along a second translational degree of freedom (y).

A further object of the present invention is an electrical plug connector (1) wherein the at least one first stop surface (10) of the electrically insulating housing assembly (2) is formed on a side wall of a fastening web (11).

A further object of the present invention is an electrical plug connector (1) wherein the at least one first stop surface (10) of the electrically insulating housing assembly (2) is formed by a step within a recess.

A still further object of the present invention is an electrical plug connector (1) wherein all fastening tabs (8), are formed in the end section (6) that projects out of the electrically insulating housing assembly (2).

An even still further object of the present invention is a method for assembling an electrical plug connector (1) wherein the outer-conductor assembly (3) is received by the electrically insulating housing assembly (2) such that the electrically insulating housing assembly (2) blocks a relative movement between the outer-conductor assembly (3) and the electrically insulating housing assembly (2) in positively locking fashion along a second translational degree of freedom (y).

In compliance with the statute, the present invention has been described in language more or less specific, as to structural and methodical features. It is to be understood, however, that the invention is not limited to the specific features shown and described since the means herein disclosed comprise preferred forms of putting the invention into effect. The invention is, therefore, claimed in any of its forms or modifications within the proper scope of the appended claims appropriately interpreted in accordance with the Doctrine of Equivalents.

The invention claimed is:

1. An electrical plug connector (1), comprising:

an electrically insulating housing assembly (2); and an outer-conductor assembly (3) that is connected in a positively locking fashion to the electrically insulating housing assembly (2); and wherein the outer-conductor assembly (3) has at least one fastening tab (8), and the at least one fastening tab can be bent from a basic state into a fastening state; and the outer-conductor assembly (3) is inserted at least in certain regions into the electrically insulating housing assembly (2) so that the outer-conductor assembly (3) is surrounded by the electrically insulating housing assembly (2) at least at two mutually opposite sides such that the electrically insulating housing assembly (2) blocks a relative movement between the outer-conductor assembly (3) and the electrically insulating housing assembly (2) in positively locking fashion along at least one of a first translational degree of freedom (x) or along a second translational degree of freedom (y), and wherein the at least one fastening tab (8), in the basic state, allows an assembling movement for assembling the electrically insulating housing assembly (2) on the outer-conductor assembly (3) along a third translational degree of freedom (z) and, the at least one fastening tab (8) in the bent fastening state, blocks the electrically insulating housing assembly (2) on the outer-conductor assembly (3) in positively locking fashion at least along the third translational degree of freedom (z).

2. The electrical plug connector (1) as claimed in claim 1 and wherein a bending axis (B) along which the at least one fastening tab (8) can be bent from the basic state into the fastening state is parallel to, or at least substantially parallel to, the third translational degree of freedom (z).

3. The electrical plug connector (1) as claimed in claim 1 and further comprising:

at least one fastening tab pair (9) which is formed from two fastening tabs (8) which are arranged on opposite sides of the outer-conductor assembly (3).

4. The electrical plug connector (1) as claimed in claim 3 and wherein the fastening tabs (8) of the at least one fastening tab pair (9) can be bent toward one another from the basic state to the fastening state.

5. The electrical plug connector (1) as claimed in claim 3 and wherein the fastening tabs (8) of the at least one fastening tab pair (9) are arranged at a same axial position along a longitudinal axis (L) of the outer-conductor assembly (3).

6. The electrical plug connector (1) as claimed in claim 1 and wherein the electrically insulating housing assembly (2) has at least one first stop surface (10) which, when the outer-conductor assembly (3) is in the electrically insulating housing assembly (2), and the at least one fastening tab (8) is in the fastening state, blocks displacement, counter to the assembling movement, of the outer-conductor assembly (3), and counter to the assembling movement in positively locking fashion along the third translational degree of freedom (z).

7. The electrical plug connector (1) as claimed in claim 6 and wherein the at least one first stop surface (10) of the electrically insulating housing assembly (2) is formed on a side wall of a fastening groove.

8. The electrical plug connector (1) as claimed in claim 1 and further comprising:

at least one second stop surface (10') carried by the electrically insulating housing for the at least one fastening tab (8); and the at least one second stop surface (10') forms an end stop for the insertion of the outer-conductor assembly (3) into the electrically insulating housing assembly (2) along the assembling movement.

9. The electrical plug connector (1) as claimed in claim 1 and wherein the electrically insulating housing assembly (2) has at least one bevel (12) along which at least one of the at least one fastening tabs (8) can be bent from the basic state into the fastening state.

10. The electrical plug connector (1) as claimed in claim 1 and wherein an intended plugging-in direction (S) along which the electrical plug connector (1) can be connected to a corresponding counterpart plug connector is parallel to the third translational degree of freedom (z).

11. The electrical plug connector (1) as claimed in claim 1 and further comprising:

a mechanical interface carried by the electrically insulating housing assembly (2) for connection of the electrical plug connector (1) to a corresponding counterpart plug connector.

12. The electrical plug connector (1) as claimed in claim 11 and wherein the outer-conductor assembly (3) has an end section (6) that projects out of the electrically insulating housing assembly (2) at an end (5) of the electrically insulating housing assembly (2) which is opposite the mechanical interface, and wherein at least one of the at least one fastening tabs (8), are formed in the end section (6) that projects out of the electrically insulating housing assembly (2).

13. The electrical plug connector (1) as claimed in claim 1 and further comprising:

contact pins, preferably press-in pins (7), carried by the outer-conductor assembly (3) for installation in a metal-plated hole defined in an electrical assembly.

14. The electrical plug connector (1) as claimed in claim 1 and wherein the outer-conductor assembly (3) is formed from a stamped and bent part.

15. A method for assembling an electrical plug connector (1), the method comprising the steps:

providing an electrically insulating housing assembly (2);

providing an outer-conductor assembly (3);

connecting the electrically insulating housing assembly to the outer-conductor assembly (3) by inserting the outer conductor assembly (3) into the electrically insulating housing assembly (2) in an assembling movement (M)

that extends along a third translational degree of freedom (z) whilst at least one fastening tab (8) carried by the outer-conductor assembly (3) is in a basic state, and wherein, after the outer-conductor assembly (3) has reached an end state in the electrically insulating housing assembly (2), the at least one fastening tab (8) is bent into a fastening state to block the electrically insulating housing assembly (2) on the outer-conductor assembly (3) in positively locking fashion at least along the third translational degree of freedom (z); and the outer-conductor assembly (3) is inserted at least in certain regions into the electrically insulating housing assembly (2) so that the outer-conductor assembly (3) is surrounded by the electrically insulating housing assembly (2) at least at two mutually opposite sides so that the electrically insulating housing assembly (2) blocks a relative movement between the outer-conductor assembly (3) and the electrically insulating housing assembly (2) in positively locking fashion along at least one of a first translational degree of freedom (x) or along a second translational degree of freedom (y); and bending at least one fastening tab (8) from the basic state into the fastening state to create the positively locking connection at least along the third translational degree of freedom (z).

16. The electrical plug connector (1), as claimed in claim 1 and wherein the outer-conductor assembly (3) is received in the electrically insulating housing assembly (2) such that the electrically insulating housing assembly (2) blocks the relative movement between the outer-conductor assembly (3) and the electrically insulating housing assembly (2) in positively locking fashion along the first translational degree of freedom (x) and along a second translational degree of freedom (y).

17. The electrical plug connector (1) as claimed in claim 6 and wherein the at least one first stop surface (10) of the electrically insulating housing assembly (2) is formed on a side wall of a fastening web (11).

18. The electrical plug connector (1) as claimed in claim 6 and wherein the at least one first stop surface (10) of the electrically insulating housing assembly (2) is formed by a step within a recess.

19. The electrical plug connector (1) as claimed in claim 11 and wherein all fastening tabs (8), are formed in the end section (6) that projects out of the electrically insulating housing assembly (2).

20. The method for assembling an electrical plug connector (1) as claimed in claim 15 and wherein the outer-conductor assembly (3) is received by the electrically insulating housing assembly (2) such that the electrically insulating housing assembly (2) blocks a relative movement between the outer-conductor assembly (3) and the electrically insulating housing assembly (2) in positively locking fashion along a second translational degree of freedom (y).

21. An electrical plug connector (1), comprising:

an electrically insulating housing assembly (2); and an outer-conductor assembly (3) that is connected in a positively locking fashion to the electrically insulating housing assembly (2); and wherein the outer-conductor assembly (3) has at least one fastening tab (8), and the at least one fastening tab can be bent from a basic state into a fastening state; and the outer-conductor assembly (3) is received in the electrically insulating housing assembly (2) such that the electrically insulating housing assembly (2) blocks a relative movement between the outer-conductor assembly (3) and the electrically insulating housing assembly (2) in positively locking fashion along at least one of a first translational degree of freedom (x) or along a second translational degree of freedom (y), and wherein the at least one fastening tab (8), in the basic state, allows an assembling movement for assembling the electrically insulating housing assembly (2) on the outer-conductor assembly (3) along a third translational degree of freedom (z) and, the at least one fastening tab (8) in the bent fastening state, blocks the electrically insulating housing assembly (2) on the outer-conductor assembly (3) in positively locking fashion at least along the third translational degree of freedom (z); and a mechanical interface carried by the electrically insulating housing (2) for connection of the electrical plug connector (1) to a corresponding counterpart plug connector; and wherein the outer-conductor assembly (3) has an end section (6) that projects out of the electrically insulating housing assembly (2) at an end (5) of the electrically insulating housing assembly (2) which is opposite the mechanical interface, and wherein at least one of the at least one fastening tabs (8), are formed in the end section (6) that projects out of the electrically insulating housing assembly (2).

22. An electrical plug connector (1), comprising:

an electrically insulating housing assembly (2); and an outer-conductor assembly (3) that is connected in a positively locking fashion to the electrically insulating housing assembly (2); and wherein the outer-conductor assembly (3) has at least one fastening tab (8), and the at least one fastening tab can be bent from a basic state into a fastening state; and the outer-conductor assembly (3) is received in the electrically insulating housing assembly (2) such that the electrically insulating housing assembly (2) blocks a relative movement between the outer-conductor assembly (3) and the electrically insulating housing assembly (2) in positively locking fashion along at least one of a first translational degree of freedom (x) or along a second translational degree of freedom (y), and wherein the at least one fastening tab (8), in the basic state, allows an assembling movement for assembling the electrically insulating housing assembly (2) on the outer-conductor assembly (3) along a third translational degree of freedom (z) and, the at least one fastening tab (8) in the bent fastening state, blocks the electrically insulating housing assembly (2) on the outer-conductor assembly (3) in positively locking fashion at least along the third translational degree of freedom (z); and a mechanical interface carried by the electrically insulating housing (2) for connection of the electrical plug connector (1) to a corresponding counterpart plug connector; and wherein all fastening tabs (8), are formed in the end section (6) that projects out of the electrically insulating housing assembly (2).

* * * * *